US007000323B1

(12) United States Patent
Hatcher et al.

(10) Patent No.: US 7,000,323 B1
(45) Date of Patent: Feb. 21, 2006

(54) FIXED-BLADE KNIFE WITH PIVOTABLE SIDE PIECES

(75) Inventors: Brandon Hatcher, San Diego, CA (US); Stephen J. Hull, San Diego, CA (US); Dean Hussey, Alpine, CA (US); Eric P. Linn, El Cajon, CA (US); Robert L. Pinto, Campo, CA (US); Michael E. Williams, San Diego, CA (US); Mathew Hlavac, El Cajon, CA (US)

(73) Assignee: Buck Knives, Inc., Post Falls, ID (US)

( * ) Notice: Subject to any disclaimer, the term of this patent is extended or adjusted under 35 U.S.C. 154(b) by 121 days.

(21) Appl. No.: 10/376,973

(22) Filed: Feb. 27, 2003

Related U.S. Application Data

(63) Continuation-in-part of application No. 09/758,915, filed on Jan. 10, 2001, now Pat. No. 6,594,906.

(51) Int. Cl.
*B26B 3/06* (2006.01)
*B26B 11/00* (2006.01)

(52) U.S. Cl. ..... 30/155; 30/161; 30/298.4; 7/118

(58) Field of Classification Search ..... 30/153, 30/155, 159, 161, 298.4; 7/118–120; 24/599.1, 24/600.9, 601.7; D8/99
See application file for complete search history.

(56) References Cited

U.S. PATENT DOCUMENTS

| | | | | | |
|---|---|---|---|---|---|
| 565,497 | A | * | 8/1896 | Murray | 30/155 |
| 728,416 | A | * | 5/1903 | Rowland | 30/153 |
| 1,475,301 | A | * | 11/1923 | Hartles | 30/161 |
| 1,701,027 | A | | 2/1929 | Brown | |
| 2,530,236 | A | * | 11/1950 | Erickson | 30/159 |
| 3,172,583 | A | | 3/1965 | Smith | |
| 3,263,329 | A | * | 8/1966 | Hennessy | 30/155 |
| 4,095,316 | A | | 6/1978 | Gabriel | |
| 4,333,212 | A | | 6/1982 | Bibollet | |
| 4,439,922 | A | * | 4/1984 | Sassano | 30/161 |
| 4,494,310 | A | | 1/1985 | Slaughter | |
| 4,535,539 | A | * | 8/1985 | Friedman et al. | 30/161 |
| 4,651,419 | A | * | 3/1987 | Reed, Jr. | 30/152 |
| 4,776,094 | A | | 10/1988 | Glesser | |
| 4,802,279 | A | | 2/1989 | Rowe | |
| 4,917,281 | A | | 4/1990 | Ostermiller | |
| 5,270,909 | A | | 12/1993 | Weiss | |
| 5,283,920 | A | | 2/1994 | Plummer | |
| 5,293,690 | A | * | 3/1994 | Cassady | 30/161 |
| 5,329,675 | A | | 7/1994 | McLean et al. | |

(Continued)

FOREIGN PATENT DOCUMENTS

| | | | | | |
|---|---|---|---|---|---|
| DE | 19946 | * | 2/1882 | | 30/161 |

(Continued)

*Primary Examiner*—Allan N. Shoap
*Assistant Examiner*—Jason Prone
(74) *Attorney, Agent, or Firm*—Townsend and Townsend and Crew LLP

(57) ABSTRACT

A fixed-blade knife includes a unitary blade having an implement, a tang, and a pivot region between the implement and the tang. The unitary blade is disposed between a pair of parallel and spaced-apart side pieces that pivot to cover or expose the implement. In the pivoted position wherein the implement is exposed, the side pieces form part of the handle that is used to grasp the knife. A locking structure locks the side pieces in a selectable position, and a limit structure prevents overrotation of the side pieces.

26 Claims, 3 Drawing Sheets

U.S. PATENT DOCUMENTS

| | | | | | |
|---|---|---|---|---|---|
| 5,425,196 | A | | 6/1995 | Schwarze | |
| 5,441,185 | A | | 8/1995 | Dragos | |
| 5,450,670 | A | | 9/1995 | Sakai | |
| 5,463,798 | A | | 11/1995 | Wurzer | |
| 5,495,673 | A | | 3/1996 | Gardiner | |
| 5,572,793 | A | | 11/1996 | Collins | |
| 5,628,117 | A | | 5/1997 | Glesser | |
| 5,647,129 | A | | 7/1997 | Stamper | |
| 5,704,129 | A | | 1/1998 | Glesser | |
| 5,727,319 | A | | 3/1998 | Myerchin | |
| 5,815,927 | A | * | 10/1998 | Collins | 30/161 |
| 5,822,866 | A | | 10/1998 | Pardue | |
| 5,822,867 | A | | 10/1998 | Sakai | |
| 5,875,552 | A | | 3/1999 | Chen | |
| 5,878,834 | A | | 3/1999 | Brainerd et al. | |
| 5,953,821 | A | | 9/1999 | Mearns | |
| 5,966,816 | A | | 10/1999 | Roberson | |
| 5,983,686 | A | | 11/1999 | Lee | |
| 6,079,106 | A | * | 6/2000 | Vallotton | 30/161 |
| 6,113,617 | A | | 9/2000 | van der Merwe | |
| 6,223,372 | B1 | | 5/2001 | Barber | |
| D444,685 | S | * | 7/2001 | Shenkel et al. | D8/18 |
| 6,256,888 | B1 | | 7/2001 | Shuen | |
| 6,289,592 | B1 | | 9/2001 | Emerson | |
| 6,397,477 | B1 | * | 6/2002 | Collins | 30/161 |
| 6,402,763 | B1 | | 6/2002 | Scott | |
| 6,430,816 | B1 | * | 8/2002 | Neveux | 30/161 |
| 6,434,831 | B1 | * | 8/2002 | Chen | 30/161 |
| 6,470,522 | B1 | * | 10/2002 | Veltz et al. | 30/153 |
| D472,446 | S | * | 4/2003 | Brown | D8/99 |
| D474,095 | S | * | 5/2003 | Luquire | D8/99 |
| 6,594,906 | B1 | * | 7/2003 | Sakai et al. | 30/155 |
| D484,770 | S | * | 1/2004 | Green | D8/99 |
| D501,781 | S | * | 2/2005 | Galli | D8/99 |
| 2004/0231163 | A1 | * | 11/2004 | Sakai | 30/161 |
| 2005/0144730 | A1 | * | 7/2005 | Barber et al. | 7/138 |

FOREIGN PATENT DOCUMENTS

| | | | | |
|---|---|---|---|---|
| GB | 11190 | * | 5/1898 | 30/161 |

* cited by examiner

FIXED-BLADE KNIFE WITH PIVOTABLE SIDE PIECES

This application is a continuation-in-part of application Ser. No. 09/758,915, filed Jan. 10, 2001, now U.S. Pat. No. 6,594,906 for which priority is claimed and whose disclosure is incorporated by reference.

This invention relates to a fixed-blade knife and, more particularly, to such a knife with pivotable side pieces and limiting and locking structures that limit the pivoting of the side pieces and controllably lock the side pieces in relation to the blade.

BACKGROUND OF THE INVENTION

Knives may be generally classified as fixed-blade and folding-blade types. The common hunting knife and folding pocket knife are examples. The fixed-blade knife includes a backbone structure that defines an implement such as a blade with a cutting edge, and a tang to which the sides of the handle are affixed. The folding-blade knife typically joins the implement to the handle with a pivot structure. Because the sharp blade of a knife potentially can cause injury or damage when the knife is not intentionally in use, provision must be made to store the knife safely.

Fixed-blade knives are stronger and more capable of heavy duty service than folding-blade knives. When the fixed-blade knife is not in use, it is placed into a sheath that protects the knife edge from being damaged, and also protects the user of the knife and others from being injured by the sharp edge. The fixed-blade knife remains its full length when in the sheath, so that the sheath is typically carried externally to the clothing such as on a belt attachment. The sheath is a separate piece from the fixed-blade knife, and there is always the possibility that it will not be available for storage of the knife, as for example if the sheath is lost. Additionally, it is possible to damage leather and other flexible sheath materials with the cutting edge of the blade, particularly when the blade is inserted into the sheath.

The folding-blade knives are not as strong as the fixed-blade knives, because the working force must be transmitted through the pivot mechanism into the handle, but they allow the blade to be folded away for storage between the sides of the handle. The folding of the knife blade also makes the knife more compact for storage. Even so, large folding knives are sometimes carried in sheaths.

For some situations, a knife must have the strength associated with the fixed-blade knife. However, it may be inconvenient to store the knife in an externally carried sheath, due both to size and visual considerations.

There is a need for a knife which has the strength of the fixed-blade knife but is more conveniently and safely stored. The present invention fulfills this need, and further provides related advantages.

SUMMARY OF THE INVENTION

The present invention provides a fixed-blade knife with an integral side-piece structure that may serve as either part of the handle or as a cover that protects the blade in storage. The side pieces may be made sufficiently large so that the integral blade is recessed well within the boundaries of the side pieces when the side pieces are pivoted to their closed position, protecting the edge of the blade from external contacts that would either damage the edge or cause the edge to injury someone. A locking mechanism retains the side pieces in a desired position, such as a fully open or fully closed position. A preferred form of the locking mechanism automatically releasably locks the side pieces into the desired positions, when those blade positions are reached during rotation of the side pieces. It may also be made to releasably lock the folding blade into other positions, such as half open. The preferred locking release is conveniently located on the side of the fixed-blade knife and can be readily located by the fingers of the user of the fixed-blade knife. The approach produces a strong, positive lock that is stronger than a liner lock and whose mechanism does not increase the size and profile of the fixed-blade knife. The lock is stable, so that there is no looseness of the blade in the locked position. The lock is easy to use, and opening and unlocking can be accomplished with one hand.

A fixed-blade knife having a pivotable handle structure comprises a unitary blade having an implement, a tang, and a pivot region between the implement and the tang, wherein the blade lies in a blade plane. As used herein, "unitary" means that the blade is made of a single piece of material, typically a metal such as steel or titanium alloy. The implement may be of any operable type, but desirably includes a cutting edge. The knife further includes a pair of parallel and spaced-apart side pieces having the blade disposed therebetween, wherein the side pieces are pivotable relative to the blade about a pivot axis that is perpendicular to the blade plane, and a side-piece locking mechanism that releasably locks the side pieces in at least one pivoted position. Desirably, the side-piece locking mechanism locks the side pieces in a first pivoted position wherein the side pieces overlie the tang, also termed an "open position", and also locks the side pieces in a second pivoted position wherein the side pieces overlie the implement, also termed a "closed position". It may lock the side pieces into other positions as well. Preferably fasteners extend between the side pieces to hold the side pieces in the parallel and spaced-apart orientation and spacing. The fasteners are positioned so as not to interfere with pivoting of the side pieces between the closed position and the open position.

In one design, the unitary blade includes a blade pivot bore through the pivot region, a locking slot through the pivot region, wherein the locking slot comprises a locking-slot angular segment of constant radius centered on the blade pivot bore, and an enlarged locking-slot bore at an end of the locking slot. Preferably, the locking-slot segment is a semicircle. Each side piece includes a handle pivot bore aligned with the blade pivot bore, and the fixed-blade knife further includes a pivot pin extending through the handle pivot bores and the blade pivot bore and lying on a pivot axis. The side-piece locking mechanism preferably comprises a lock-access opening extending through the first side piece and aligned with the locking slot, a recess in the second side piece aligned with the lock-access opening and lying parallel to the pivot axis, and a locking button received through the lock-access opening and the locking slot, received in the recess, and lying parallel to the pivot axis. The locking button is preferably cylindrically symmetric about a button axis. The locking button includes a head sized to be accessible through the lock-access opening, a base sized to be slidably received in the recess, a locking wedge extending from the base toward the head, wherein the locking wedge is too large to fit through the locking slot but does fit into and engage a side of the enlarged locking-slot bore when it is aligned with the recess, a shank connecting the head and the locking wedge, wherein the shank is sized to fit through the locking slot, and a biasing structure which biases the locking button toward the first side piece.

Optionally, a limit structure prevents overrotation of the side pieces past a position corresponding to the alignment of the locking button with the enlarged locking-slot bore. The preferred form of the limit structure includes a limit pin extending on each side of the blade, and a limit slot in at least one, and preferably each, of the side pieces. The limit slot comprises a limit-slot angular segment of constant radius centered on the blade pivot bore. The limit pin of the blade engages the limit slot, and the angular length of the limit slot determines the permitted angular rotation of the blade. Typically, the permitted angular rotation of the blade coincides with the position or positions of the enlarged locking-slot bores. The limit structure is desirably present to provide a reaction force against the force of the locking wedge against the side of the enlarged locking-slot bore when the blade is locked, so that there is a secure lock without mechanical play.

An important feature of the unitary blade is the tang that extends from the pivot region generally oppositely to the implement. In a preferred case, the unitary blade is elongated in a direction of elongation, and a length of the tang measured parallel to the direction of elongation is at least about one-fourth of the length of the unitary blade measured parallel to the direction of elongation, but preferably the tang is not less than about 1¼ inches *long*. T*he* tang may have a tang implement thereon that is exposed when the side pieces are pivoted away from the *tang*.

The presence of the tang distinguishes the present fixed-blade knife from conventional folding-blade knives. In the present case, the tang, which is integral with the implement, transfers the working force applied through the implement into the hand of the user of the knife, through the side pieces if they are rotated to the open position to overlie the tang, or directly if the side pieces are rotated out of the way. The working force is thus distributed over a relatively large area. In a conventional folding knife, the working force applied when the implement is open is transferred through the pivot mechanism of the folding blade and thence to the handle. This pivot mechanism is a weak link in the chain of force application. The locking mechanism for the side pieces of the present approach reacts any force seeking to unlock the implement from its locked position through the thickness of the material that constitutes the unitary blade, rather than through relatively thin or narrow notches, edges, and similar locking contact surfaces that are usually employed in the locks of folding knifes. Thus, both the primary working-force reaction and the locking force of the side pieces are substantially stronger than those found in conventional folding-blade knives.

The present invention thus provides a strong fixed-blade knife with side pieces that may be pivoted to an open position so that the implement of the unitary blade is exposed for use, or to a closed position so that side pieces overlie and protect the implement. Automatic locking features and a limit structure may be provided for the pivoting of the side pieces. The side pieces of the fixed-blade knife are securely locked into a selected position and readily unlocked with a push-button release on the side of the knife. There is substantially no mechanical play in the locked-open or locked-closed side pieces.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
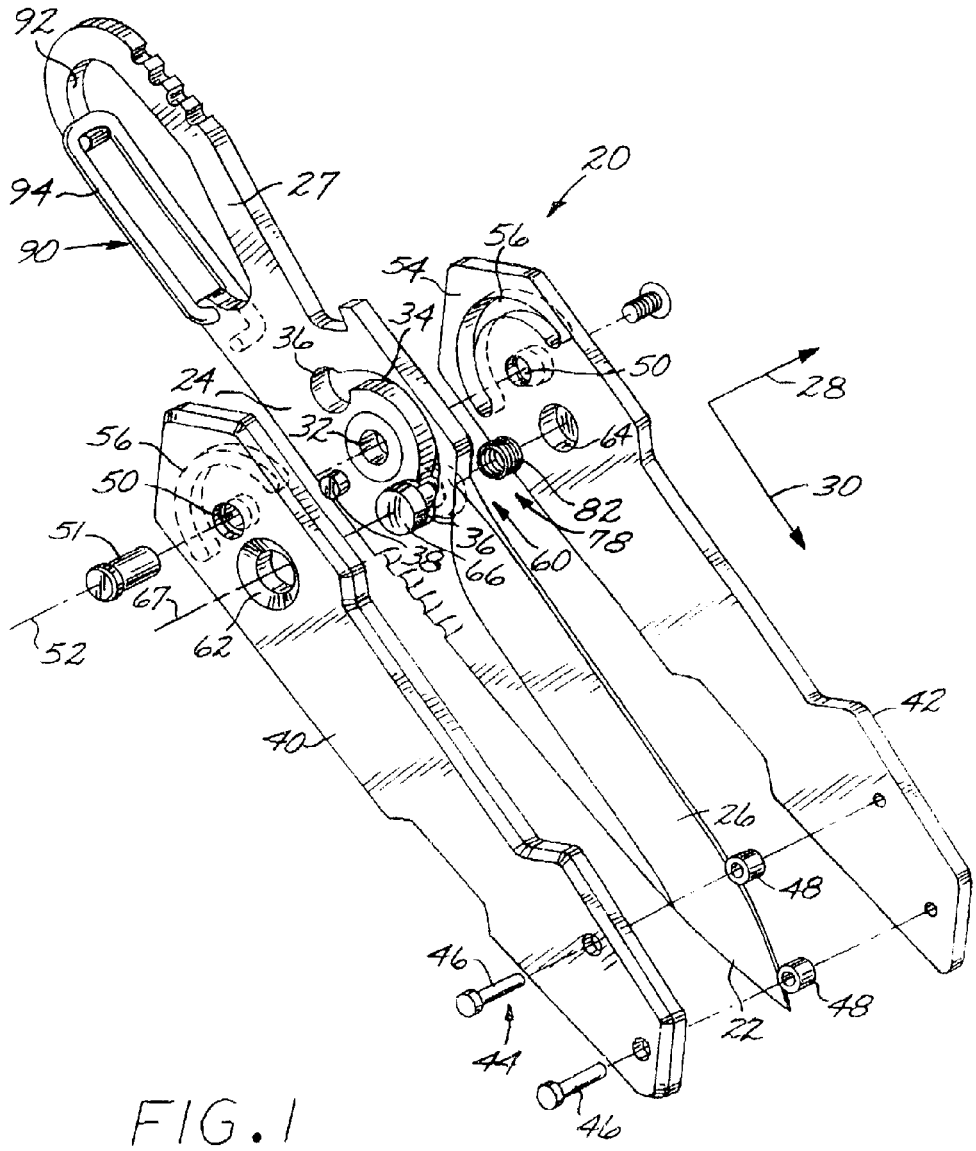
FIG. 1 is an exploded perspective view of a preferred embodiment of the fixed-blade knife of the invention.
Figure 2:
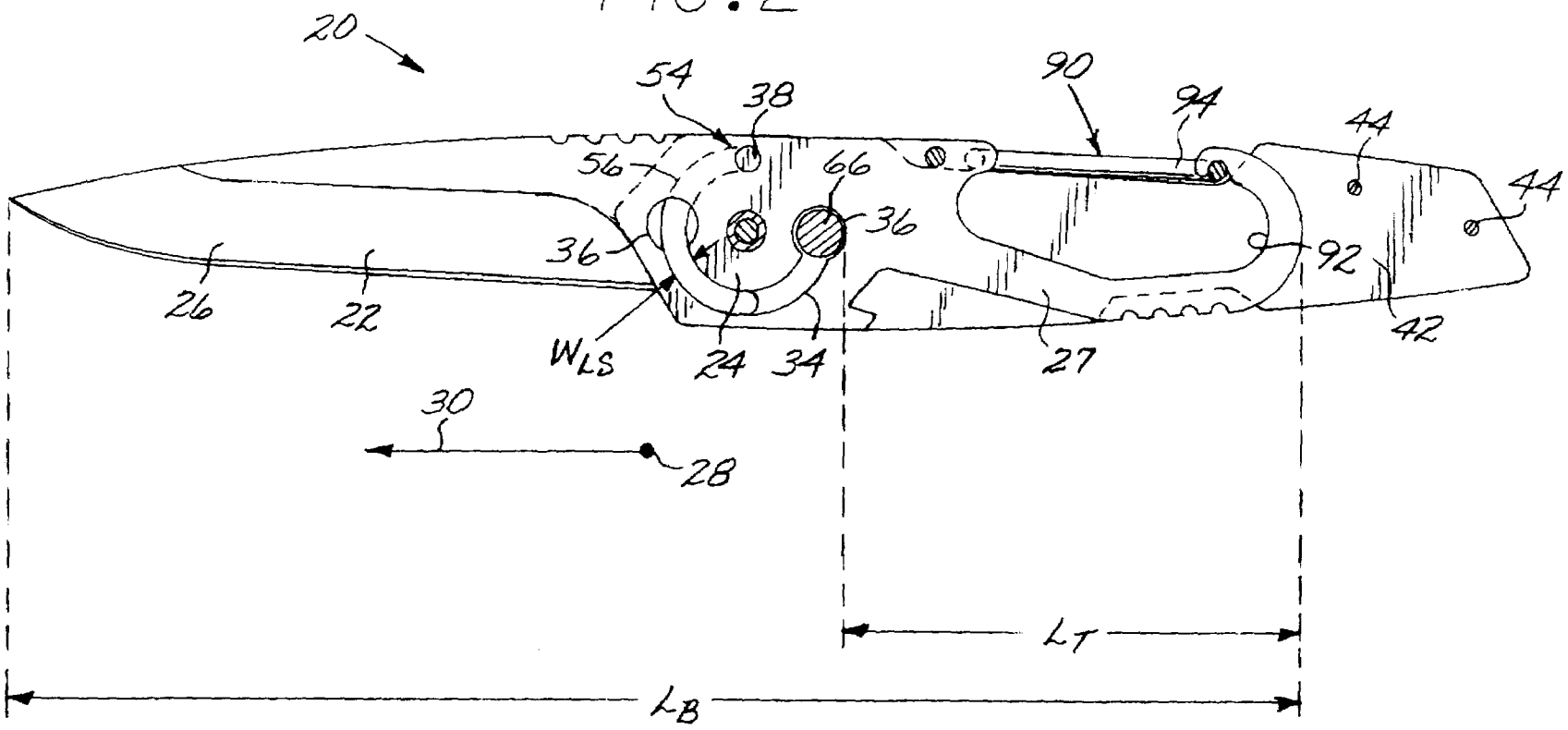
FIG. 2 is a schematic side view of the fixed-blade knife.

FIGS. 1–2 depict a fixed-blade knife 20 that includes a unitary blade 22 having a pivot region 24, an implement 26 extending in one direction from the pivot region 24, and a tang 27 extending in the opposite direction from the pivot region 24. That is, the pivot region 24 lies between the implement 26 and the tang 27. As used herein, a "blade" is any article that is generally thin in a first dimension 28 and longer in a second dimension 30 (also termed the "direction of elongation" of the unitary blade 22) that is perpendicular to the first dimension 28. The thin dimension 28 lies perpendicular to a "blade plane", which is the plane of the illustration in FIG. 2, and the direction of elongation 30 lines in the blade plane. As used herein, "unitary blade" refers to a blade made of a single piece of material. In this case, the entire unitary blade, including the implement 26, the pivot region 24, and the tang 27 are all made of the same piece of material, typically a metal such as steel or titanium alloy.

The implement 26 may be of any operable type, such as a blade with a cutting edge (as illustrated), a saw, a file, and the like. The unitary blade 22 includes a blade pivot bore 32 extending completely through the pivot region 24 of the unitary blade 22 parallel to its first (thin) dimension 28.

There is a locking slot 34 extending through the pivot region 24 of the unitary blade 22 in the direction parallel to its first (thin) dimension 28. The locking slot 34 is a locking-slot angular segment of constant radius centered on the blade pivot bore 32. That is, the locking slot 34 subtends an angular segment of a circle. Most preferably, it is a semicircular angular segment extending 180 degrees about the blade pivot bore 32. The locking slot 34 has a width $W_{LS}$ measured along a radius vector (relative to the blade picot bore 32) of the angular segment.

An enlarged locking-slot bore 36 is positioned at one or both (as depicted) ends of the locking slot 34. The enlarged locking-slot bore 36 extends transversely through the pivot region 24 of the blade 22 parallel to its first (thin) dimension 28. The enlarged locking-slot bore 36 is preferably, but not necessarily, cylindrical. The enlarged locking-slot bore 36 has a minimum cross-sectional dimension that is larger than the locking slot width $W_{LS}$. In the preferred case where the enlarged locking-slot bore 36 is cylindrical, the cross-sectional cylindrical diameter is greater than $W_{LS}$.

Preferably but not necessarily, a limit pin 38 extends outwardly from a side of the unitary blade 22, and preferably from a side of the blade pivot region 24, in the direction parallel to the first (thin) dimension 28. Most preferably, there is a limit pin 38 extending out from each side of the unitary blade 22. The limit pin 38 is used in a preferred limit structure that limits the rotation of the unitary blade 22, which will be discussed subsequently.

The fixed-blade knife 20 includes a pair of parallel and spaced-apart side pieces 40 and 42, with the unitary blade 22 disposed therebetween. Preferably, fasteners 44 such as rivets 46 and spacers 48 extend between the side pieces 40 and 42 to hold the side pieces 40 and 42 in the parallel and spaced-apart orientation, and to ensure that the side pieces 40 and 42 pivot together and simultaneously. The fasteners 44 are dimensioned lengthwise to hold the side pieces 40 and 42 spaced apart properly a distance sufficiently large to accommodate the unitary blade 22 therebetween, but not so large that a finger may enter into the space between the side-pieces so as to cause injury when the side pieces are rotated to the closed position. The fasteners 44 are positioned so as not to interfere with movement of the unitary blade 22 as the side pieces 40 and 42 rotate between a first pivoted position wherein the side pieces overlie the tang 27, termed an "open position", and a second pivoted position wherein the side pieces overlie the implement 26, termed a "closed position". When the side pieces 40 and 42 are in the "closed" position as shown in FIG. 1, the implement 26 lies between the side pieces 40 and 42. The implement 26 is thereby protected from damage, and it cannot cause injury or damage. When the side pieces 40 and 42 are in the open "position" as shown in FIG. 2, the implement 26 does not lie between the side pieces 40 and 42 so that the implement may be used for its function, and preferably the side pieces are rotated 180 degrees from their closed position.

When the side pieces 40 and 42 are in the open position of FIG. 2 and preferably locked into this open position overlying the tang 27, the side pieces 40 and 42 serve as a handle for a user of the fixed-blade knife 20. The user may thereby conveniently grasp the fixed-blade knife 20 in the hand and manipulate the unitary blade 22 to perform its function. This handle functionality of the side pieces 40 and 42 is comparable to the handle function of the side bolsters of a fixed-blade knife, where working force is applied to the implement 26 from the hand of the user into the side pieces 40 and 42, transferred into the tang 27 over a large portion of its length, and thence transferred into the implement 26. To this end, it is preferred that a length of the tang 27 measured parallel to the direction of elongation 30 of the unitary blade 22, the dimension $L_T$ in FIG. 2, is at least about one-fourth of the length of the unitary blade measured parallel to the direction of elongation 30, the dimension $L_B$ in FIG. 2, but in no event less than about 1¼ inches ($L_T$ as illustrated is measured from the remote end of the tang 27 to the nearest point of the enlarged locking-slot bore 36, if present. If there is no enlarged locking-blot bore present, $L_T$ is measured to the center of the pivot pin 51, and the dimension now indicated as about 1¼ inches is instead about 1½ inches.) If the radio $L_T/L_B$ is substantially less than about ¼, then it is difficult to achieve a satisfactory force transfer into the implement 26 primarily through the tang 27, and instead an unacceptably large proportion of the working force is transferred through the pivoting and limiting structure. The numerical value of LT is preferably in any event not less than about 1¼ inches, because even in a small knife there must be a sufficient length to transfer the blade forces into the hand of the user.

In the present approach, then, the working forces are not transferred to any significant extent through the pivot structure, locking structure, and limiting structure (described subsequently) found in and adjacent to the pivot region 24. This working-force transfer approach is distinct from that of a folding-blade knife, where the working force applied to the implement through the handle is transferred substantially entirely through the pivoting and locking structures.

Each side piece 40 and 42 includes a handle pivot bore 50 parallel to the first (thin) dimension 28 and aligned with the blade pivot bore 32. The handle pivot bores 50 preferably extend completely through the side pieces 40 and 42, but they may be terminated within the side pieces 40 and 42. A pivot pin 51 extends through the handle pivot bores 50 and the blade pivot bore 32 and lie on a pivot axis 52 that extends parallel to the first (thin) direction 28. The unitary blade 22 pivots on the pivot pin 51 about the pivot axis 52, between the closed position of FIG. 1 and the open position of FIG. 2.

There is desirably, but not necessarily, a limit structure 54 that prevents overrotation of the unitary blade 22 past its desired limits of rotation. In a preferred embodiment, the limit pin 38 forms part of this limit structure 54, and the remainder is a limit slot 56 in at least one, and preferably both, of the side pieces 40 and 42. The limit slot 56 is a slot that preferably extends either part of the way through the side piece from the interior side facing the unitary blade 22, or it may extend all of the way through the side piece. The limit slot 56 is a limit-slot angular segment of constant radius centered on the blade pivot bore 32. That is, the limit slot 56 subtends an angular segment of a circle. Most preferably, it is a semicircular angular segment extending 180 degrees about the blade pivot bore 32. The limit slot 56 has a width sufficiently great so that the limit pin 38 of the unitary blade 22 engages the limit slot 56. The limit slot 56 is preferably present in each of the side pieces 40 and 42, and the limit pin 38 preferably extends from both sides of the unitary blade 22. The limit slot 56 is preferably angular offset, most preferably by 90 degrees, from the locking slot 34 to provide room for the limit pin 38.

The fixed-blade knife 20 further includes a blade locking mechanism 60. The blade locking mechanism 60 includes a lock-access opening 62 extending through the first side piece 40 and aligned with the locking slot 34. A recess 64 in the second side piece 42 is aligned with the lock-access opening 62 and lies parallel to the pivot axis 52. A locking button 66 is received through the lock-access opening 62 and the locking slot 34 and in the recess 64. The locking button 66 is preferably cylindrically symmetric about a button axis 67 which lies parallel to the pivot axis 52 so that the locking button 66 lies parallel to the pivot axis 52.

Figure 3:
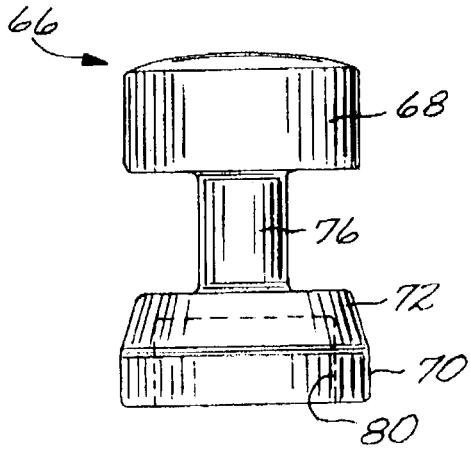
FIG. 3 is an elevational view of the locking button.

The structure of the locking button 66 is illustrated in greater detail in FIG. 3. The locking button 66 includes a head 68 sized to be accessible by a finger of the user of the fixed-blade knife 20 through the lock-access opening 62. A base 70 of the locking button 66 is sized to be slidably received in the recess 64 of the second side piece 42 so that the locking button 66 may slide parallel to the button axis 67 and to the pivot axis 52. A locking wedge 72 extends from the base 70 toward the head 68. The locking wedge 72 is relatively larger in size (cylindrical diameter in the preferred case) at its junction with the base 70 and tapers inwardly to a smaller size (cylindrical diameter in the preferred case) with increasing distance from the base 70 toward the head 68. The locking wedge 72 at its larger size is too large to fit through the locking slot 34 but does fit into and engage by a wedging action a side 74 of the enlarged locking-slot bore 36 when the enlarged locking-slot bore 36 is aligned with the recess 64. The side pieces 40 and 42 are thereby releasably locked into position relative to the unitary blade 22, with the enlarged locking-slot bore 36 aligned with the lock-access opening 62 and the recess 64. A shank 76 connects the head 68 and the locking wedge 72. The shank 76 is sized to fit through the locking slot 34.

A biasing structure 78 biases the locking button 66 toward the first side piece 40. The biasing structure 78 preferably includes a spring bore 80 within the base 70 and opening toward the second side piece 42, and extending coincident with the button axis 67 and parallel to the pivot axis 52. A spring 82, preferably a coil spring, lies within the spring bore 80 and reacts between a bottom of the spring bore 80 and a bottom of the recess 64 in the second side piece 42. The spring 82 thus biases the locking button 66 toward the first side piece 40.

Figure 4:
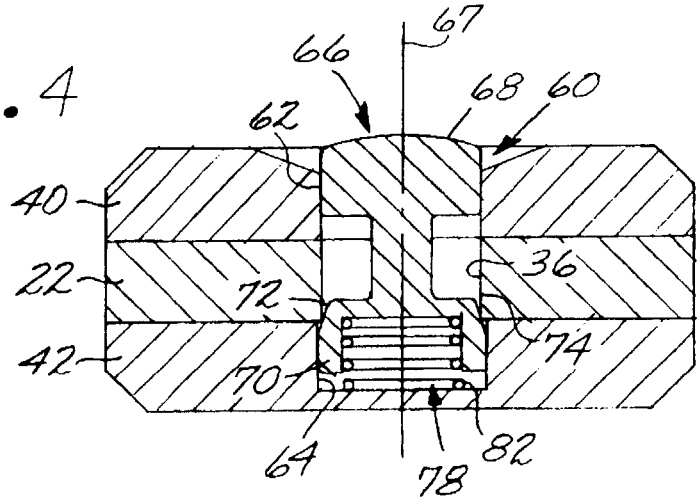
FIG. 4 is a sectional view of the blade locking mechanism with the side pieces locked, taken on line 4—4 of FIG. 2.
Figure 5:
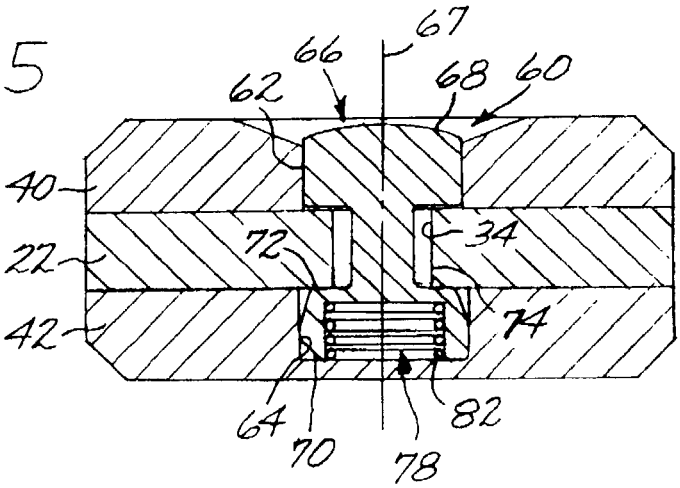
FIG. 5 is a sectional view like that of FIG. 4, except with the side pieces unlocked.

FIGS. 4–5 illustrate the operation of the blade locking mechanism 60. As illustrated in FIG. 4, when the enlarged locking-slot bore 36 is aligned with the lock-access opening 62 and the recess 64, the locking button 66 moves upwardly so that the locking wedge 72 engages and wedges against the side 74 of the enlarged locking-slot bore 36. The unitary blade 22 is thereby locked into this position, which usually is selected to coincide with either the unitary blade 22 fully closed and lying between the side pieces 40 and 42 (FIG. 1), or the unitary blade 22 fully open and extended outwardly from the side pieces 40 and 42 (FIG. 2).

When the unitary blade 22 is to be unlocked, the user of the fixed-blade knife 20 pushes on the head 68 through the lock-access opening 62 and depresses the head 68 toward the second side piece 42 against the biasing force of the spring 82, so that the locking wedge 72 no longer contacts the side 74 of the enlarged locking-slot bore 36. In this position of the locking button 66, the unitary blade 22 may be rotated away from the locked position. During this rotation, the shank 76 extends through the locking slot 34 but the locking wedge 72 cannot fit into the locking slot 34. The user may release the pressure on the head 68 of the locking button 66, and the top surface of the locking wedge 72 rides against the side of the unitary blade 22 that faces the second side piece 42 because the locking wedge 72 is too small to fit through the locking slot 34, as shown in FIG. 5. When the unitary blade 22 is rotated to a position such that either the same enlarged locking-slot bore 36 or a different enlarged locking-slot bore 36 is aligned with the lock-access opening 62 and the recess 64, the locking button 66 moves back to the position shown in FIG. 4 under the influence of the biasing of the spring 82. The unitary blade 22 is thereby locked into this position until the unlocking is repeated.

The wedging action of the blade locking mechanism 60 is highly desirable. In initial studies it was found that, without the locking wedge 72 and its wedging action, the unitary blade 22 was only loosely held in the locked position so that there was a substantial degree of looseness and play in the mechanism. This looseness was a result of the manufacturing clearances that are necessarily present between the locking button 66 and the walls of the recess, the enlarged locking-slot bore, and the lock-access opening. The unitary blade 22 wobbled slightly and felt loose and unstable to the user, which is undesirable. By including the wedging action, this looseness and play is wedged out of the blade locking mechanism 60. This wedging action is operable when there is no limit structure 54 present. However, the wedging action is even more effective when the limit structure 54 is present, inasmuch as the wedging action of the blade locking mechanism forces the limit pin 38 against the side of the limit slot 56 to give additional strength and stability against movement of the unitary blade 22.

Because the tang 27 is exposed when the side pieces 40 and 42 are in the closed position as illustrated in FIG. 1, the tang 27 may include a tang implement 90 as illustrated in FIGS. 1 and 2. In these figures, the tang implement 90 includes a recess 92 in the tang 27 and a spring-loaded gate 94 extending across the mouth of the recess 92. The spring-loaded gate 94 may be in the position illustrated, or it may be pushed back to allow access to the recess past the gate 94. The implement 90 thus functions as a carabineer-type clip by which the entire fixed-blade knife 20 may be affixed to an external structure (not shown) such as a D-ring on a backpack, a rope, a belt loop, or the like. Other types of tang implements 90 may also be used.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A fixed-blade knife having a pivotable handle structure, the knife comprising:

a unitary blade having an implement, a tang, and a pivot region between the implement and the tang, wherein the unitary blade lies in a blade plane and wherein the tang comprises a carabiner-type clip;

a pair of parallel and spaced-apart side pieces having the unitary blade disposed therebetween, wherein the side pieces are pivotable relative to the unitary blade about a pivot axis that is perpendicular to the blade plane; and a side-piece locking mechanism that releasably locks the side pieces in at least one pivoted position.

2. The fixed-blade knife of claim 1, wherein the side-piece locking mechanism locks the side pieces in a first pivoted position wherein the side pieces overlie the tang, and also locks the side pieces in a second pivoted position wherein the side pieces overlie the implement.

3. The fixed-blade knife of claim 1, the unitary blade comprising:

a blade pivot bore through the pivot region, a locking slot through the pivot region, wherein the locking slot comprises a locking-slot angular segment of constant radius centered on the blade pivot bore, and an enlarged locking-slot bore at an end of the locking slot.

4. The fixed-blade knife of claim 3, each side piece comprising:

a handle pivot bore aligned with the blade pivot bore, and the fixed-blade knife further comprising a pivot pin extending through the handle pivot bore of each side piece and the blade pivot bore and lying on a pivot axis.

5. The fixed-blade knife of claim 4, wherein the side-piece locking mechanism comprises a lock-access opening extending through the first side piece and aligned with the locking slot, a recess in the second side piece aligned with the lock-access opening and lying parallel to the pivot axis, a locking button received through the lock-access opening and the locking slot, received in the recess, and lying parallel to the pivot axis, wherein the locking button comprising:

a head sized to be accessible through the lock-access opening, a base sized to be slidably received in the recess, a locking wedge extending from the base toward the head, wherein the locking wedge is too large to fit through the locking slot but does fit into and engage a side of the enlarged locking-slot bore when it is aligned with the recess, a shank connecting the head and the locking wedge, wherein the shank is sized to fit through the locking slot, and a biasing structure which biases the locking button toward the first side piece.

6. The fixed-blade knife of claim 1, wherein the unitary blade is elongated in a direction of elongation, and wherein a length of the tang measured parallel to the direction of elongation is at least about one-fourth of the length of the unitary blade measured parallel to the direction of elongation, but in no event less than about 1¼ inches.

7. The fixed-blade knife of claim 1, wherein the carabiner-type clip is exposed when the side pieces are pivoted away from the tang.

8. A fixed-blade knife having a pivotable handle structure, the knife comprising:

a unitary blade having an implement, a tang, and a pivot region between the implement and the tang, and wherein the tang comprises a carabiner-type clip, the unitary blade comprising:

a blade pivot bore through the pivot region, a locking slot through the pivot region, wherein the locking slot comprises a locking-slot angular segment of constant radius centered on the blade pivot bore, and an enlarged locking-slot bore at an end of the locking slot;

a pair of parallel and spaced-apart side pieces having the unitary blade disposed therebetween, the pair of side pieces including a first side piece and a second side piece, wherein each side piece comprising:

a handle pivot bore aligned with the blade pivot bore, a pivot pin extending through the handle pivot bore of each side piece and the blade pivot bore and lying on a pivot axis; and a side-piece locking mechanism comprising a lock-access opening extending through the first side piece and aligned with the locking slot, a recess in the second side piece aligned with the lock-access opening and lying parallel to the pivot axis, a locking button received through the lock-access opening and the locking slot, received in the recess, and lying parallel to the pivot axis, wherein the locking button comprising:

a head sized to be accessible through the lock-access opening, a base sized to be slidably received in the recess, a locking wedge extending from the base toward the head, wherein the locking wedge is too large to fit through the locking slot but does fit into and engage a side of the enlarged locking-slot bore when it is aligned with the recess, a shank connecting the head and the locking wedge, wherein the shank is sized to fit through the locking slot, and a biasing structure which biases the locking button toward the first side piece.

9. The fixed-blade knife of claim 8, wherein the implement includes a cutting edge.

10. The fixed-blade knife of claim 8, wherein the locking-slot segment is a semicircle.

11. The fixed-blade knife of claim 8, further comprising:

fasteners extending between the side pieces to hold the side pieces in the parallel and spaced-apart orientation, wherein the fasteners are positioned so as not to interfere with pivoting of the side pieces between a closed position and an open position.

12. The fixed-blade knife of claim 8, wherein the locking button is cylindrically symmetric about a button axis.

13. The fixed-blade knife of claim 8, further comprising;

a limit structure that prevents overrotation of the side pieces past a position corresponding to the alignment of the locking button with the enlarged locking-slot bore.

14. The fixed-blade knife of claim 8, wherein the biasing structure comprises a spring reacting between the second side piece and the locking button.

15. The fixed-blade knife of claim 8, further including a second enlarged locking-slot bore positioned at an opposite end of the locking slot from the enlarged locking-slot bore.

16. The fixed-blade knife of claim 8, further comprising:

a second enlarged locking-slot bore positioned at an opposite end of the locking slot from the enlarged locking-slot bore, and a limit structure that prevents overrotation of the unitary blade past a position corresponding to the alignment of the locking button with the enlarged locking-slot bore and past a position corresponding to the alignment of the locking button with the second enlarged locking-slot bore.

17. The fixed-blade knife of claim 8, wherein the unitary blade is elongated in a direction of elongation, and wherein a length of the tang measured parallel to the direction of elongation is at least about one-fourth of the length of the unitary blade measured parallel to the direction of elongation, but in no event less than about 1¼ inches.

18. The fixed-blade knife of claim 8, wherein the carabiner-type clip is exposed when the side pieces are pivoted away from the tang.

19. A fixed-blade knife comprising:

a unitary blade having an implement, a tang, and a pivot region between the implement and the tang, and wherein the tang comprises a carabiner-type clip, the unitary blade comprising:

a blade pivot bore through the pivot region, a locking slot through the pivot region, wherein the locking slot comprises a locking-slot angular segment of constant radius centered on the blade pivot bore, an enlarged locking-slot bore at an end of the locking slot, and a limit pin extending outwardly from a side of the unitary blade;

a pair of parallel and spaced-apart side pieces having the unitary blade disposed therebetween, the pair of side pieces including a first side piece and a second side piece, wherein each side piece comprising:

a handle pivot bore aligned with the blade pivot bore, a limit slot in at least one of the side pieces, wherein the limit slot comprises a limit-slot angular segment of constant radius centered on the blade pivot bore, and wherein the limit pin of the unitary blade engages the limit slot;

a pivot pin extending through the handle pivot bore of each side piece and the blade pivot bore and lying on a pivot axis; and a side-piece locking mechanism comprising a lock-access opening extending through the first side piece and aligned with the locking slot, a recess in the second side piece aligned with the lock-access opening and lying parallel to the pivot axis, a locking button received through the lock-access opening and the locking slot, received in the recess, and lying parallel to the pivot axis, wherein the locking button comprising:

a head sized to be accessible through the lock-access opening, a base sized to be slidably received in the recess, a locking wedge extending from the base toward the head, wherein the locking wedge is too large to fit through the locking slot but does fit into and engage a side of the enlarged locking-slot bore when it is aligned with the recess, a shank connecting the head and the locking wedge, wherein the shank is sized to fit through the locking slot, and a spring bore within the base and extending parallel to the pivot axis; and a spring lying within the spring bore and reacting to a bottom of the recess in the second side piece, the spring biasing the locking button toward the first side piece.

20. The fixed-blade knife of claim 19, wherein the implement includes a cutting edge.

21. The fixed-blade knife of claim 19, wherein the locking-slot segment is a semicircle.

22. The fixed-blade knife of claim 19, wherein the limit-slot segment is a semicircle.

23. The fixed-blade knife of claim 19, further comprising:

fasteners extending between the side pieces to hold the side pieces in the parallel and spaced-apart orientation, wherein the fasteners are positioned so as not to interfere with pivoting of the side pieces between a closed position and an open position.

24. The fixed-blade knife of claim 19, wherein the locking button is cylindrically symmetric about a button axis.

25. The fixed-blade knife of claim 19, wherein the unitary blade is elongated in a direction of elongation, and wherein a length of the tang measured parallel to the direction of elongation is at least about one-fourth of the length of the unitary blade measured parallel to the direction of elongation, but in no event less than about 1¼ inches.

26. The fixed-blade knife of claim 19, wherein the carabiner-type clip is exposed when the side pieces are pivoted away from the tang.

* * * * *